US008237364B2

(12) United States Patent
Hombach et al.

(10) Patent No.: US 8,237,364 B2
(45) Date of Patent: Aug. 7, 2012

(54) DIELECTRIC BARRIER DISCHARGE LAMP CONFIGURED AS A DOUBLE TUBE

(75) Inventors: Axel Hombach, Kürten (DE); Oliver Rosier, Wipperfürth (DE); Markus Roth, Bonn (DE); Siegmar Rudakowski, Ratingen (DE)

(73) Assignee: Osram AG, Munich (DE)

( * ) Notice: Subject to any disclaimer, the term of this patent is extended or adjusted under 35 U.S.C. 154(b) by 71 days.

(21) Appl. No.: 12/734,402

(22) PCT Filed: Nov. 26, 2007

(86) PCT No.: PCT/EP2007/062784

§ 371 (c)(1),
(2), (4) Date: Apr. 29, 2010

(87) PCT Pub. No.: WO2009/068073

PCT Pub. Date: Jun. 4, 2009

(65) Prior Publication Data

US 2010/0253246 A1 Oct. 7, 2010

(51) Int. Cl.

| | |
|---|---|
| ***H01J 11/00*** | (2012.01) |
| ***H01J 17/30*** | (2006.01) |
| ***H01J 17/00*** | (2006.01) |
| ***H01J 61/00*** | (2006.01) |

(52) U.S. Cl. ..... 313/595; 313/567; 313/581; 313/608

(58) Field of Classification Search ..... None
See application file for complete search history.

(56) References Cited

U.S. PATENT DOCUMENTS

| | | | | |
|---|---|---|---|---|
| 4,837,484 | A * | 6/1989 | Eliasson et al. | 313/634 |
| 5,386,170 | A * | 1/1995 | Kogelschatz | 313/17 |
| 5,581,152 | A | 12/1996 | Matsuno et al. | |
| 7,687,997 | B2 * | 3/2010 | Gaertner et al. | 313/634 |

FOREIGN PATENT DOCUMENTS

| | | |
|---|---|---|
| EP | 0 642 153 A1 | 3/1995 |
| EP | 0 642 153 B1 | 3/1995 |
| EP | 1 059 659 A1 | 12/2000 |

OTHER PUBLICATIONS

Korean Office Action dated Aug. 8, 2011.
Chinese Office Action dated Jul. 6, 2011.

* cited by examiner

*Primary Examiner* — Natalie Walford
(74) *Attorney, Agent, or Firm* — Holtz, Holtz, Goodman & Chick, PC

(57) ABSTRACT

The invention relates to a dielectric barrier discharge lamp in a coaxial double-tube arrangement, comprising an exterior electrode (6), and interior electrode (7), and an auxiliary electrode (8). The interior electrode (7) is designed as an electrically conductive layer placed inside the interior tube (3) of the double-tube arrangement. The auxiliary electrode (8) is designed, for example, as a metal tube or pipe and is also disposed inside the interior tube (3), specifically in direct contact with the layer. In this manner, the conductivity of the interior electrode (S) is improved.

11 Claims, 3 Drawing Sheets

8
10
11
12
10'
13
10"

DIELECTRIC BARRIER DISCHARGE LAMP CONFIGURED AS A DOUBLE TUBE

This application is a U.S. National Phase Application under 35 USC 371 of International Application PCT/EP2007/062784, filed Nov. 26, 2007, which is incorporated herein in its entirety by this reference.

TECHNICAL FIELD

The invention is based on a dielectric barrier discharge lamp with a discharge vessel with a coaxial double-tube arrangement, i.e. an inner tube is arranged coaxially within an outer tube. In this case, the inner tube and the outer tube are connected to one another at both of their end sides and thus form the gas-tight discharge vessel. The discharge space surrounded by the discharge vessel therefore extends between the inner tube and the outer tube.

This type of discharge lamp typically has a first electrode, which is arranged within the inner tube, and a second electrode, which is arranged on the outer side of the outer tube. Both electrodes are therefore located outside the discharge vessel or the discharge space. In this case the discharge is therefore impeded by a dielectric barrier on two sides. When mention is occasionally made below of the internal electrode or inner electrode and the external electrode or outer electrode for reasons of simplicity, this designation consequently only refers to the physical arrangement of the electrode in question with respect to the coaxial double-tube arrangement, i.e. within the inner tube or on the outer side of the outer tube. In this case, the two electrodes should bear as tightly as possible against the wall of the discharge vessel in order for the dielectrically impeded discharge to be as uniform as possible in the discharge space.

This type of lamp is used in particular for UV irradiation in processing technology, for example for surface cleaning and activation, photolytics, ozone generation, drinking water purification, metal-plating, and UV-curing. In, this context, the designation emitter or UV emitter is also conventional.

PRIOR ART

The document U.S. Pat. No. 4,945,290 has disclosed a coaxial double-tube emitter. The inner electrode is in this case in the form of a metallic layer.

The document EP 0 703 603 A1 has likewise disclosed a coaxial double-tube emitter. In said document, reference is made to the disadvantages both in terms of the vapor deposition of a metallic layer and as regards the life. It is therefore obviously not possible for a layer of uniform thickness to be vapor-deposited within the constricted inner tube of the double-tube emitter. In addition, the layer can become detached easily with a thickness of greater than approximately 0.01 mm. Furthermore, the layer is corroded in particular at thin points during operation and thus shortens the usable life of the emitter. EP 0 703 603 A1 therefore proposes a metal tube as the inner electrode instead of a metallic layer, said metal tube having a straight, continuous slot in the direction of the longitudinal axis. As an alternative, a tubular inner electrode comprising two half-shells which are spaced apart from one another is disclosed. One disadvantage is in any case the fact that neither fluctuations in the diameter along the inner tube nor undulations and other uneven sections in the circumferential direction can be compensated for.

DESCRIPTION OF THE INVENTION

The object of the present invention is to specify a dielectric barrier discharge lamp with a coaxial double-tube arrangement with an improved internal electrode.

This object is achieved by a dielectric barrier discharge lamp with a discharge vessel, which comprises an outer tube and an inner tube, the inner tube being arranged coaxially within the outer tube, the inner tube and the outer tube being connected to one another in a gas-tight manner, as a result of which a discharge space filled with a discharge medium is formed between the inner tube and the outer tube, a first electrode and at least one further electrode, the first electrode being in the form of an electrically conductive layer applied to the inner side of the inner tube, characterized by the fact that an additional electrode, which is capable of carrying current and is in electrically conductive contact with the first electrode, is arranged within the inner tube.

Particularly advantageous configurations are given in the dependent claims.

In addition, protection is claimed for an electrical emitter system with a dielectric barrier discharge lamp according to the invention and an electrical supply device which is connected thereto.

The basic concept of the invention consists in arranging an additional electrode in the inner tube of a double-tube emitter and bringing said additional electrode into electrically conductive contact with the electrically conductive layer. It has been shown that the electrically conductive layer cannot carry the current to a sufficient extent and melts through partially in the event of very high electrical powers. The additional electrode is therefore designed in such a way that it can carry some of the current during operation.

The electrical contact is preferably made by the additional electrode touching the layer as uniformly as possible. In addition, it may also be advantageous to provide a suitable connection medium, for example an electrically conductive paste, an adhesive or the like, between the layer and the additional electrode in order to further improve the electrical contact and to maintain the electrical contact for as long as possible.

In order that the current-carrying capacity of the additional electrode is at its optimum, the additional electrode preferably extends substantially over the entire axial and/or azimuthal extent of the electrically conductive layer, i.e. the entire outer surface thereof. In addition, the dimensions and shape of the additional electrode are preferably selected in such a way that electrical contact which is as effective as possible and covers as large an area as possible is made with the electrically conductive layer. Otherwise, there is the risk of increased local current densities and therefore melting-through of the layer, in particular at very high powers. However, the additional electrode does not necessarily need to cover the metallic layer of the inner tube over the entire outer surface. Instead, it may in certain circumstances also be sufficient if the additional electrode only covers part of the outer surface of the metallic layer, for example by a metallic strip of sufficient thickness being adhesively bonded, preferably axially parallel.

The additional electrode is preferably in the form of an electrically conductive, substantially circular-cylindrical structure, for example in the form of a metal tube or flexible metal tube with suitable dimensions, preferably made from a woven metallic fabric, knitted metallic fabric or the like. This ensures that the additional electrode can be introduced easily into the inner tube without the electrically conductive layer being destroyed in the process. A further aspect is that the additional electrode bears against the electrically conductive layer as well and as uniformly as possible, preferably over the entire extent of the layer. For this purpose, it is advantageous when using a metal tube to provide said metal tube with one or more slots. It can thus adapt better to the surface of the electrically conductive layer, in a similar way to a woven metallic fabric.

The electrically conductive, for example metallic layer of the inner tube consists of, for example, aluminum or a noble metal, preferably platinum, palladium or gold. It is applied by physical processes such as sputtering, vacuum vapor deposition, electroplating or chemical coating, such as baking varnishes, chemical precipitation or electroless plating.

In order to avoid scratching the thin metallic layer of the inner tube when installing the additional electrode, it may be advantageous to coat this layer in advance with a scratch-resistant protective layer, for example consisting of nickel.

With the aid of the additional electrode which is capable of carrying current, the invention makes it possible to use a metallic layer, with the associated advantage of optimum bearing contact against the inner tube, as the primary inner electrode even during permanent operation and at high electrical powers. Finally, the invention therefore proposes a two-component solution. The first component is a thin layer and is optimal for the bearing contact against the inner tube. The second component is an additional electrode which is capable of carrying current and is primarily used for the transfer of current.

An electrical emitter system according to the invention also has an electrical supply device in addition to the dielectric barrier discharge lamp according to the invention. The first terminal of the supply device is connected to the outer electrode. The second terminal of the supply device is connected to the additional electrode.

BRIEF DESCRIPTION OF THE DRAWINGS

The invention will be explained in more detail below with reference to exemplary embodiments. In the drawings.

PREFERRED EMBODIMENT OF THE INVENTION

Figure 1A:
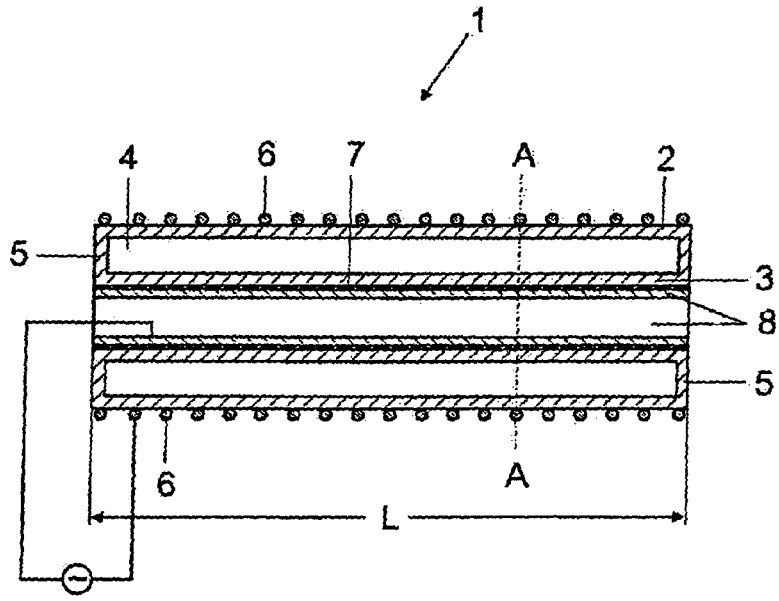
FIG. 1*a* shows an illustration of a longitudinal section through a dielectric barrier discharge lamp according to the invention.
Figure 1C:
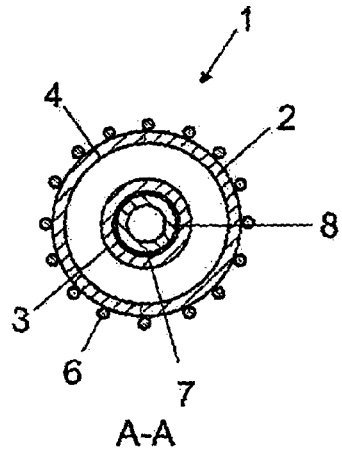
FIG. 1*c* shows a cross-sectional illustration of the lamp shown in FIG. 1*a*.
Figure 1B:
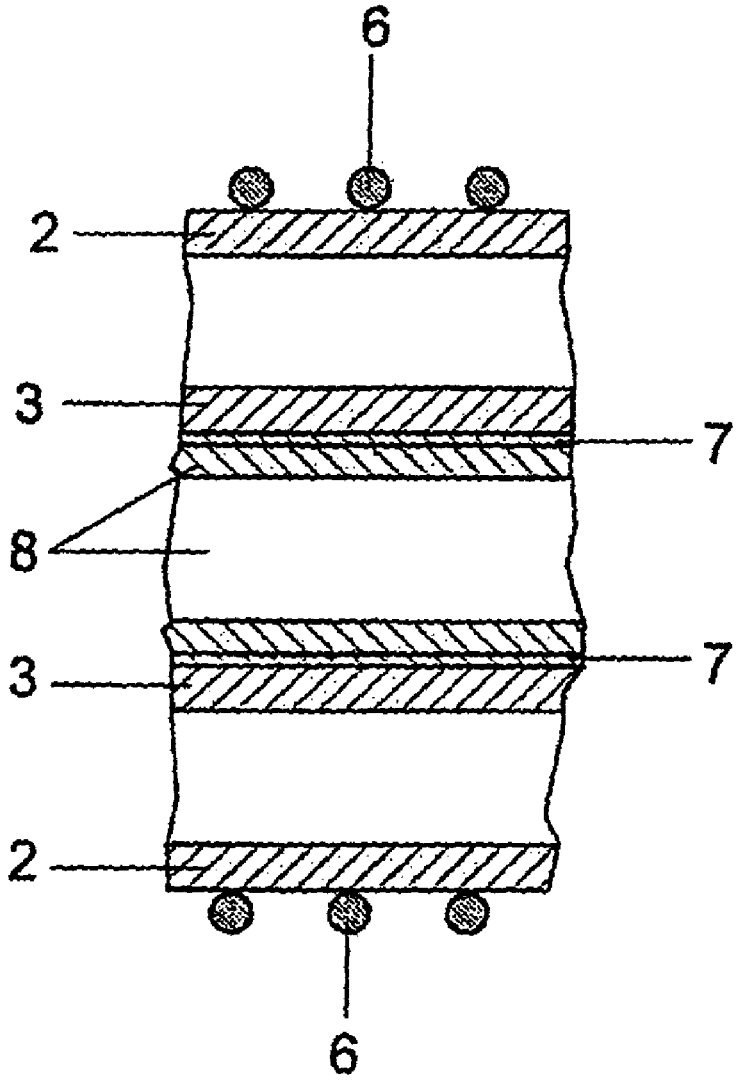
FIG. 1*b* shows an enlarged detail of the lamp shown in FIG. 1*a*.

FIGS. 1*a* to 1*c* show a very schematized illustration of a side view, an enlarged partial view and a cross-sectional illustration, respectively, of a first exemplary embodiment of the dielectric barrier discharge lamp 1 according to the invention. The elongate discharge vessel of the lamp 1 comprises an outer tube 2 and an inner tube 3 with a coaxial double-tube arrangement, said tubes thus defining the longitudinal axis of the discharge vessel. The typical length of the tubes is between approximately 10 and 250 cm, depending on the application. The outer tube 2 has a diameter of 44 mm and a wall thickness of 2 mm. The inner tube 3 has a diameter of 20 mm and a wall thickness of 1 mm. Both tubes 2, 3 are made from quartz glass which is transmissive for UV radiation. In addition, the discharge vessel is sealed at both of its end sides in such a way that an elongate discharge space 4 in the form of an annular gap is formed. For this purpose, the discharge vessel has suitably shaped, annular vessel sections 5 at each of its two ends. In addition, an exhaust tube (not illustrated) is attached to one of the vessel sections 5 and is used initially to evacuate the discharge space 4 and then to fill said discharge space with 15 kPa of xenon. A wire mesh 6 is mounted on the outer side of the wall of the outer tube 2 and forms the outer electrode of the lamp 1. In the interior of the inner tube 3, i.e. likewise outside of the discharge space 4 surrounded by the discharge vessel, a gold layer 7 which is approximately 100 nm thick is applied and acts as a tubular inner electrode. In addition, a metallic flexible fabric tube 8 made from stainless steel is arranged within the inner tube 3 and acts as additional electrode. For this purpose, the outer diameter of the flexible fabric tube 8 is selected in such a way that the flexible fabric tube 8 can firstly be used readily and without destroying the gold layer 7 and secondly there is good and uniform contact between the gold layer 7 and the flexible fabric tube 8. In order to ensure the flexibility of the flexible fabric tube 8, the wires have a thickness of preferably less than 0.5 mm. The gold layer 7 and the flexible fabric tube 8 both extend virtually over the entire length of the inner tube 3. The wire mesh 6 (outer electrode) and the flexible fabric tube 8 (additional electrode) are each connected directly to a terminal of an electrical ballast (EB) 9 for operation of the lamp. Owing to the electrical contact with the metallic flexible fabric tube 8, the gold layer 7 is consequently also connected to the electronic ballast 9 via the metallic flexible fabric tube 8, as a result of which ultimately the current-carrying effect of the flexible fabric tube 8 is produced. The electronic ballast 9 serves the purpose of starting and maintaining a dielectric barrier discharge within the discharge space 4 during operation of the dielectric barrier discharge lamp 1.

Figures 2, 3, 4, 5:
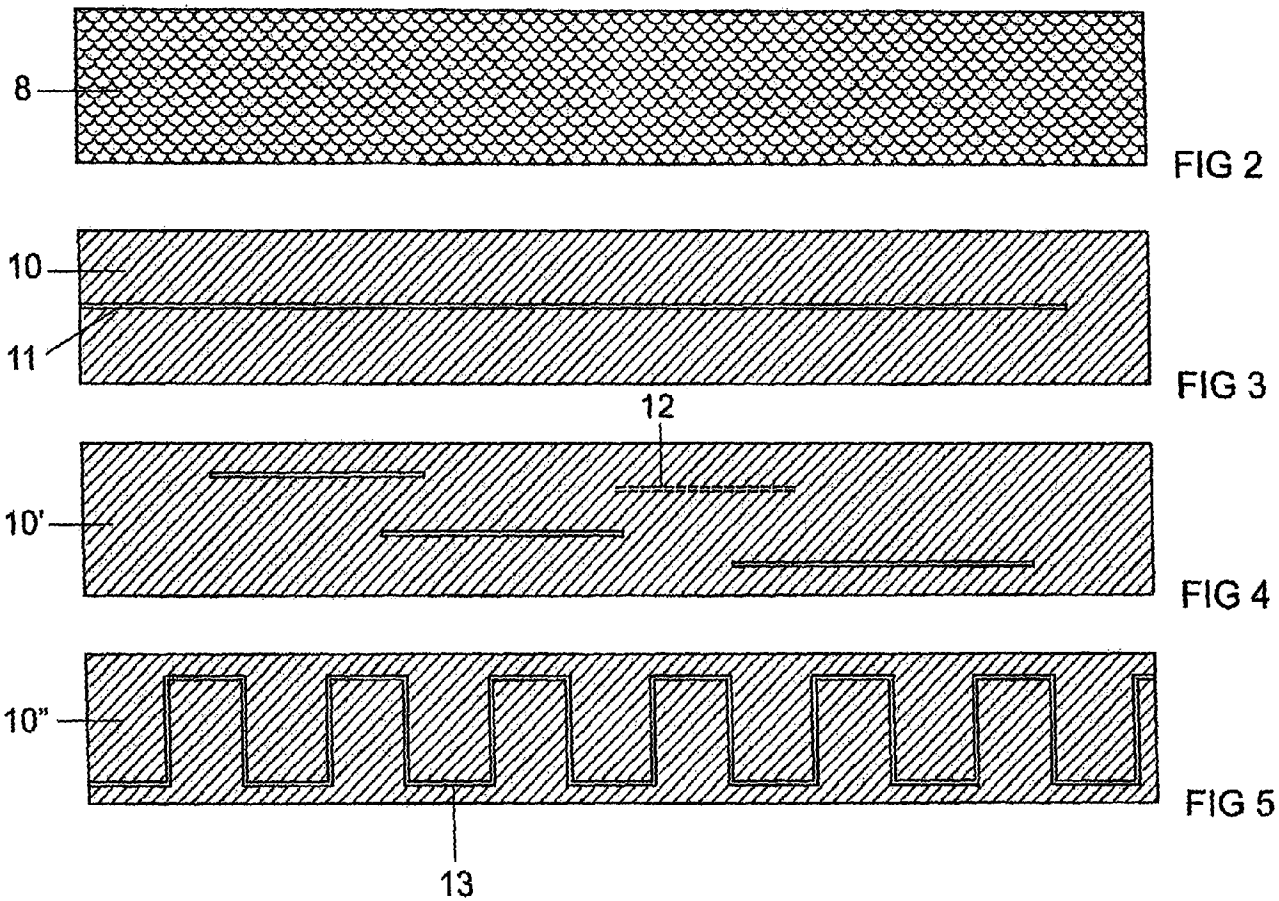
FIG. 2 shows an additional electrode in a side view.
FIG. 3 shows a variant of an additional electrode with a longitudinal slot in a side view.
FIG. 4 shows a variant of an additional electrode with a plurality of longitudinal slots in a side view.
FIG. 5 shows a variant of an additional electrode with a rectangular slot which is continuous in the longitudinal direction.

Reference is made below to FIGS. 2 to 5, which show different variants of the additional electrode, in each case in a schematic side view. FIG. 2 shows a slightly larger illustration once again of the metallic flexible fabric tube 8 used as additional electrode in FIGS. 1*a*-1*c*. This has the advantage that it is relatively flexible and can therefore be inserted particularly readily into the inner tube without damaging the gold layer 7. In addition, the metallic flexible fabric tube 8 can conform particularly well to potential uneven portions and irregularities of the inner tube 3 or the gold layer 7 and can therefore ensure particularly effective and flat electrical contact with the gold layer 7. FIG. 3 shows a metal tube 10, which has a longitudinal slot 11, which extends virtually over the entire length of the metal tube 10, typically over approximately 9/10 of the total length. Alternatively, the longitudinal slot can also be continuous. In any case, the metal tube 10, by virtue of the longitudinal slot 11, can adapt better to the metallic layer 7 of the inner tube than in the case without a slot. FIGS. 4 and 5 show further variants of a metal tube with slots as additional electrode. In FIG. 4, the metal tube 10' has a plurality of non-continuous slots 12, which are arranged so as to overlap one another when viewed parallel to the longitudinal axis and in the direction, of the longitudinal axis. In addition, the slots are preferably arranged so as to be distributed over the entire circumference of the metal tube 10'. Finally, in FIG. 5, the metal tube 10" has a rectangular slot 13 which is continuous in the longitudinal direction. As a result, the metal tube 10" can adapt even more flexibly to small uneven portions of the inner tube or the metallic layer applied thereto.

The invention claimed is:

1. A dielectric barrier discharge lamp with a discharge vessel, which comprises (i) an outer tube and an inner tube, the inner tube being arranged coaxially within the outer tube, the inner tube and the outer tube being connected to one another in a gas-tight manner, a discharge space filled with a discharge medium being formed between the inner tube and the outer tube, and (ii) a first electrode and at least one further electrode, the first electrode being in the form of an electrically conductive layer circumferentially applied to an inner side of the inner tube, wherein:

an additional electrode, which is capable of carrying current and is in electrically conductive contact with the first electrode, is arranged within the inner tube, and the electrically conductive layer has a scratch-resistant coating.

2. The lamp as claimed in claim 1, wherein the additional electrode is arranged such that it touches the electrically conductive layer.

3. The lamp as claimed in claim 1 or 2, wherein the additional electrode extends substantially over an entire axial extent of the electrically conductive layer.

4. The lamp as claimed in claim 1 or 2, wherein the additional electrode extends substantially over an entire azimuthal extent of the electrically conductive layer.

5. The lamp as claimed in claim 1 or 2, wherein the additional electrode is a substantially circular-cylindrical electrically conductive structure.

6. The lamp as claimed in claim 1 or 2, wherein the additional electrode is in the form of an electrically conductive flexible fabric tube.

7. The lamp as claimed in claim 1 or 2, wherein the additional electrode is in the form of an electrically conductive tube which has at least one slot.

8. The lamp as claimed in claim 1 or 2, wherein the electrically conductive layer consists of aluminum or a noble metal, preferably platinum, palladium or gold.

9. The lamp as claimed in claim 1, wherein the scratch-resistant coating consists of nickel.

10. The lamp as claimed in claim 1 or 2, wherein a connection medium is provided between the electrically conductive layer and the additional electrode, the connection medium comprising one of an electrically conductive paste and an adhesive.

11. An electrical emitter system comprising:

the dielectric barrier discharge lamp according to claim 1 or 2; and an electrical supply device;

wherein a first terminal of the electrical supply device is connected to the further electrode, and a second terminal of the electrical supply device is connected to the additional electrode.

* * * * *